United States Patent [19]

Goodwin et al.

[11] Patent Number: 4,895,096

[45] Date of Patent: Jan. 23, 1990

[54] BOAT SUPPORT CHOCK

[75] Inventors: Raymond Goodwin, Shrewsbury; Jack Carroll, Pepperell, both of Mass.

[73] Assignee: Monitor Marine Products, Inc., Amityville, N.Y.

[21] Appl. No.: 268,080

[22] Filed: Nov. 7, 1988

[51] Int. Cl.[4] ..... B63B 23/64

[52] U.S. Cl. ..... 114/381; 114/259; 114/364; 224/326

[58] Field of Search ..... 248/352, 146, 151; 211/70.4, 60.1, 49.1, 71; 224/323–326, 307; 188/32, 36; 410/121, 122; 114/258, 259, 343, 364, 381

[56] References Cited

U.S. PATENT DOCUMENTS

| | | | |
|---|---|---|---|
| 756,661 | 4/1904 | Lemm | 114/381 |
| 1,068,276 | 7/1913 | Rogers | 114/381 |
| 1,202,998 | 6/1916 | Hebble | 114/381 |
| 1,322,003 | 11/1919 | Freeman | 114/381 |
| 1,746,769 | 2/1930 | Ghirardi | 114/381 |

FOREIGN PATENT DOCUMENTS

| | | | |
|---|---|---|---|
| 11368 | of 1891 | United Kingdom | 114/381 |
| 8605 | of 1894 | United Kingdom | 114/381 |

*Primary Examiner*—Joseph F. Peters, Jr.
*Assistant Examiner*—Clifford T. Bartz
*Attorney, Agent, or Firm*—Charles R. Fay

[57] ABSTRACT

A chock for a small boat carried by a larger boat, to be used in the plural to carry the smaller boat on e.g., a deck and comprising a base for temporary attachment to the deck, a front short upright wall, a rear longer like wall spaced from the front wall, and a concave convex strength member between the tops of the walls. A strut extends from the juncture of the base and rear longer wall to the convex side of the concave member, the strut being in the form of a box beam of I section.

6 Claims, 2 Drawing Sheets

BOAT SUPPORT CHOCK

BACKGROUND OF THE INVENTION

Cabin cruisers, yachts, and similar boats all must have some type of life saving small boat. Sometimes these life saving boats are towed in the water, and sometimes a yacht will have room on the top side of the cabin to store the life saving boat, or it may be carried on davits. Many yachts do not have such areas as are suitable for carrying the life saver, and the owner does not want to tow, so that the life saving boat, while necessary, may be in the way, and if not secured, will slide about an pose a hazard. It is the object of this invention to provide an inexpensive securing device for the smaller boat, in a pre-planned location, and to the best advantage for safety and preservation of the small boat. A preferred location for the chocks and small boat is on the fore-deck in front of the cabin, or similar place.

SUMMARY OF THE DISCLOSURE

The small boat chock of this invention is a unitary, one-piece plastic molded article comprising a base in flat, generally rectangular shape, a longer rear wall member integral with the base and at a right angle thereto, a front wall member of lesser length than the rear wall member, and also integral with the base and parallel to the rear wall member. The front and rear wall members are located at the opposite ends of the base, and are joined by an integral curved member having an upwardly facing concave surface. All the members and the base are preferably of the same or similar width and thickness. A box-like strut connects the curved member and the base and rear wall member approximately at the area of juncture thereof. The strut comprises a pair of flat flange members that are spaced and parallel and uneven in length, the shorter flange member extending from the rear wall member to the curved member, and the longer flange member extnding from the base to the curved member. The two spaced, parallel strut flange members are equal in width to the other members and are joined by a central web. The whole strut is about radial to a circle of which the curved member is a part but is located as a whole closer to the front wall member than to the rear wall member along the curve. It is believed that the construction described is as strong or stronger than any other like purpose boat chock of the same or similar material, e.g. a moldable plastic that is impervious to salt water.

PREFERRED EMBODIMENT OF THE INVENTION

Figure 1:
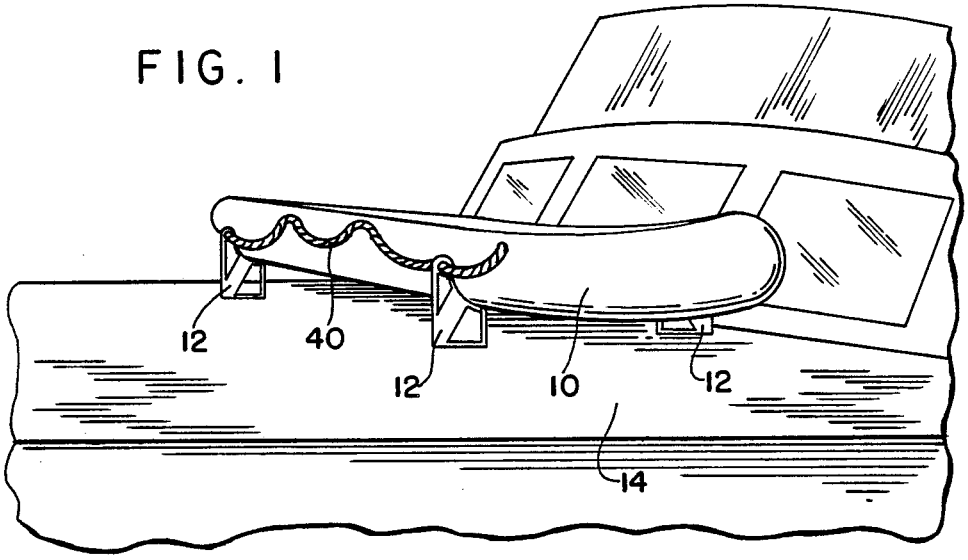
FIG. 1 is a perspective view showing a small boat in place on chocks on a yacht.
Figure 2:
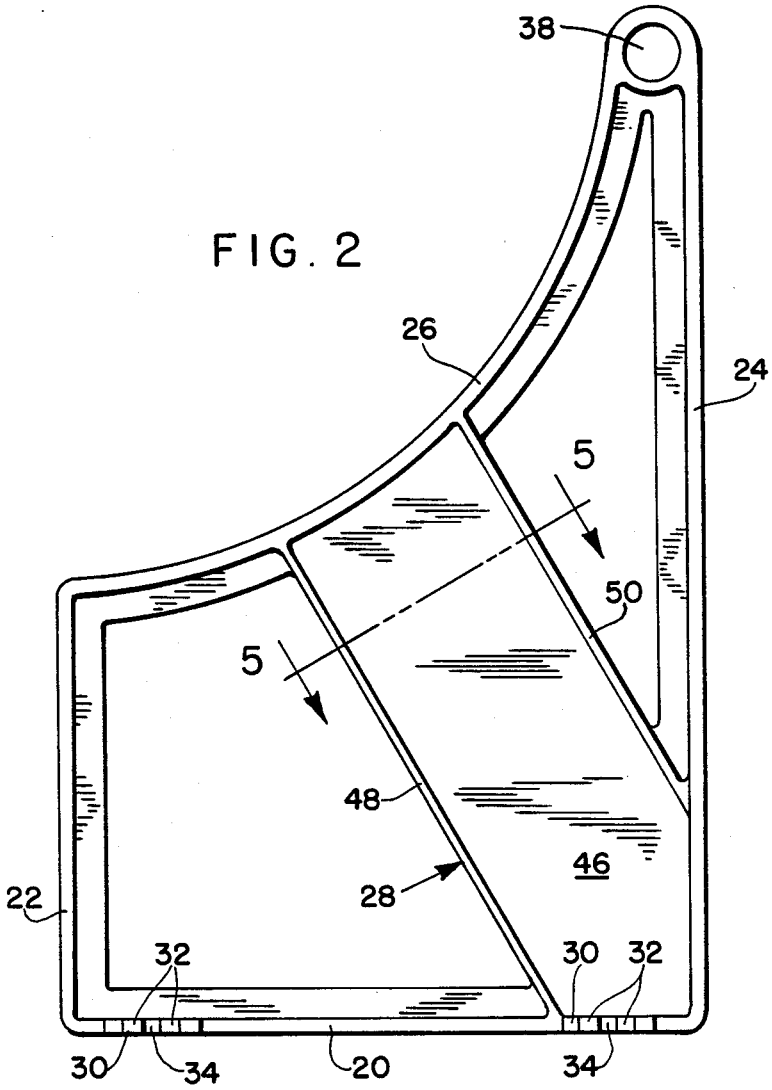
FIG. 2 is a view in side elevation of the chock.
Figure 3:
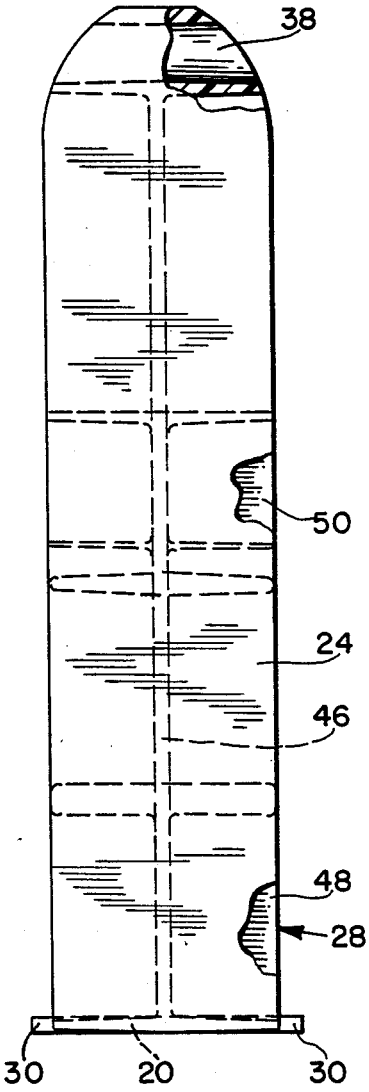
FIG. 3 is a rear elevational view of the chock.
Figure 4:
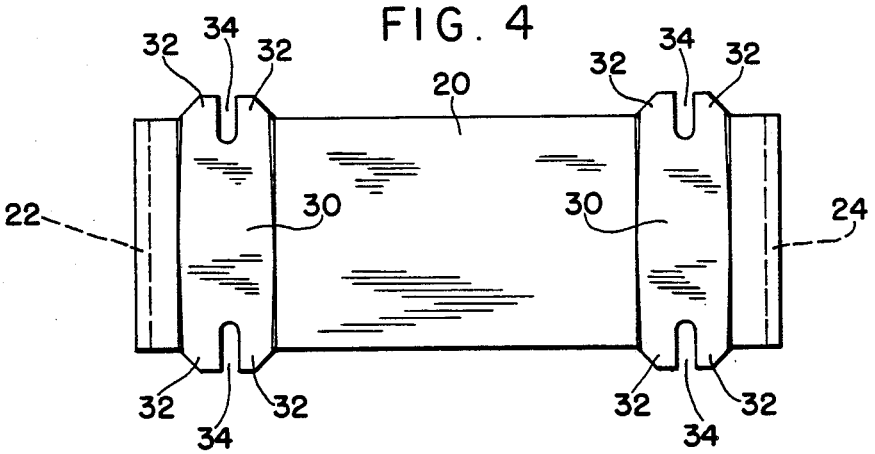
FIG. 4 is a bottom plan view thereof.
Figure 5:
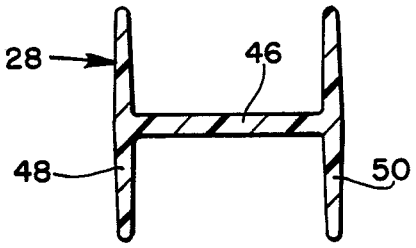
FIG. 5 is a sectional view on line 5—5 of FIG. 1.

Referring first to FIG. 1 of the drawing, it will be seen that most small boats, such as the inflatable boat 10, are well supported and secured by four chocks 12, 12, two chocks at each side edge of the small boat 10. The chocks can be placed at any area of the yacht, as may be convenient, and is some cases the chocks can be placed closer together than as shown if FIG. 1, to support the small boat on edge. Here, the chocks are located on the fore deck 14, which may be the roof area of a cabin.

The chock essentially comprises a base 20, a front shorter wall member 22, a longer rear wall member 24, and connecting the front and rear wall members at their top ends, is a curved wall member 26 upon which the small boat 10 is supported. There is also the strengthening strut 28 to be described. The base is provided with tabs 30 which have outstanding ears 32 in which are provided slots 34 opening outwardly and extending into the area of the base to accept fasteners not shown to secure the chocks to the deck or other under-support. These tabs may be slightly thicker than the base if desired.

The juncture of the longer rear wall member with the curved wall is structured from a transverse rope-eye 38 for securing the rope 40, or other like rope, usually found on this type of inflatable boat, to secure the latter, or these eyes may be used to accommodate other ropes to secure other types of small boats. It will be seen that the curved wall and the rear wall of the chock are in effect separated, while still being integral.

The base and all three walls may be of the same width and thickness, and strut 28 may be of somewhat lesser thickness but is of the same lateral width as the base and walls. This strut comprises a web 46 connecting a longer flange 48 and a shorter flange 50. The shorter flange 50 extends from a line above the base on the rear wall member to the underside of the curved wall, and the longer flange 48 extends in parallel to the other flange from tab 30 to the underside of the curved wall closer to the shorter wall. Thus, the strut bears weight close to the shorter wall 22 and thereby gives increased support where needed most along the curved wall, at the lower range thereof, where the weight of the life saving boat is concentrated, whether the latter is arranged horizontally or vertically.

The small boat is held off the deck surface to the extent of the shorter front wall 22, and the deck under it can be washed and otherwise cleaned without disturbing either the several chocks or the boat they support, while the vision of those in the cabin is not obstructed.

We claim:

1. A boat support chock comprising a one-piece unitary molded plastic unit including a substantially rectangular flat base, means on the base co-planar with the base for attachment to a boat deck, a rear wall member at one end of the base and at a right angle to the flat base, longer than the base, and having the same width as the flat base, a front wall member at the other end of the rectangular flat base, at a right angle thereto parallel to the rear member and approximately one-half the length thereof, a curved member connecting the top ends of the front and rear members, the curved member presenting an upper, boat supporting member on the chock with a concave upper surface, the arc presented by the curved member having a radial projection at angles to the base and both rear and front wall members, a supporting strut extending from the area of the junction of the base and the rear member, to the convex side surface of the curved member said strut having a width equal to the widths of base and members, the strut comprising two plane elements in spaced parallel relation, and including a web extending parallel to and between said two elements.

2. The chock of claim 1 including a rope receiving eye structure forming the juncture between the rear member and the curved member, said eye structure being adapted to receive a rope on the boat to be mounted on the chock.

3. The chock of claim 2 wherein the chock has a general plane at a right angle to the base and the curved member and the front and rear members, and the eye structure is at a right angle to the chock plane and parallel to the width of the rear and curved members.

4. The chock of claim 1 wherein said web is at a right angle to the elements and is generally centrally located there between.

5. The chock of claim 4 including a strengthening rib within the chock, said rib extending generally along and centrally of both front and rear members, the base and the curved member, except within the strut where the web is in continuity with the rib.

6. The chock of claim 1 including two pairs of lateral extensions on the base, and slots in said extensions and base to accept fasteners.

* * * * *